United States Patent [19]

Craigmile

[11] Patent Number: 4,955,746

[45] Date of Patent: Sep. 11, 1990

[54] PORTABLE CLEANING DEVICE FOR GOLF CLUBS

[76] Inventor: Joseph M. Craigmile, 1003 N. Cooper, Columbia, Mo. 65203

[21] Appl. No.: 389,176

[22] Filed: Aug. 3, 1989

[51] Int. Cl.[5] ..... A46B 11/04

[52] U.S. Cl. ..... 401/131; 222/510; 401/278

[58] Field of Search ..... 401/282, 279, 290, 278, 401/131; 222/510

[56] References Cited

U.S. PATENT DOCUMENTS

| | | | |
|---|---|---|---|
| 248,757 | 10/1881 | Kearney | 401/131 X |
| 470,461 | 3/1892 | Banta | 401/278 |
| 1,476,610 | 12/1923 | Herbert | 401/282 |
| 1,542,333 | 6/1925 | Buehrer . | |
| 1,936,724 | 11/1933 | Lupo | 401/278 |
| 1,940,002 | 12/1933 | Martin . | |
| 2,095,433 | 10/1937 | Brunauer | 401/278 |
| 2,636,203 | 4/1953 | Glantz | 401/278 |
| 2,952,026 | 9/1960 | LaPland . | |
| 3,146,484 | 9/1964 | Lussier | 401/186 |
| 3,564,779 | 2/1971 | Koehn | 401/278 |
| 3,698,824 | 10/1972 | Lorio | 401/205 |
| 4,043,681 | 8/1977 | Funahashi | 401/278 |
| 4,166,626 | 9/1979 | Sandor | 401/193 |
| 4,734,952 | 4/1988 | Parchment | 15/160 |

*Primary Examiner*—Richard J. Johnson
*Attorney, Agent, or Firm*—Grace J. Fishel

[57] ABSTRACT

A portable cleaning device for golf clubs has a reservoir for containing cleaning fluid, a scrubbing means attached to the bottom of the reservoir and a valve means for controlling the flow of the cleaning fluid into the scrubbing means. The user can control the valve by straightening the fingers of his hand while holding the device in one hand and the golf club to be cleaned in the other.

8 Claims, 3 Drawing Sheets

PORTABLE CLEANING DEVICE FOR GOLF CLUBS

BACKGROUND OF THE INVENTION

The present invention relates to a portable device for cleaning golf clubs.

The face of most if not all golf clubs is grooved to give a golf ball a selected direction of spin when the ball is struck. Dirt, mud or grass interferes with this action and adversely affects the golfer's game.

At the present time, most golfers simply spit on the club and wipe off the dirt with a towel. U.S. Pat. No. 4,734,952 to Parchment et al. describes a small tub lined with brushes into which the head of a club can be dipped but the size of the tub and volume of cleaning fluid render the apparatus not conveniently portable other than on a golf cart.

In view of the above, there is a need for a portable cleaning device for golf clubs which can be conveniently carried by the golfer on his person or as an accessory to his bag. It is therefore an object of the present invention to provide such a device. Other objects and features of the invention will be in part apparent and in part pointed out hereinafter.

The invention accordingly comprises the constructions hereinafter described and their equivalents, the scope of the invention being indicated by the following claims.

SUMMARY OF THE INVENTION

A portable cleaning device for golf clubs has a reservoir for containing cleaning fluid, a scrubbing means attached to the bottom of the reservoir and a valve means for controlling the flow of the cleaning fluid into the scrubbing means. The reservoir has a base, sidewalls and a top with an opening closed with a removable cap which is resiliently biased in a direction away from the base but which is flexible such that it can be bent in a direction towards the base by the user. The valve means has a valve housing formed in the base of the reservoir with a valve seat into which is seated a valve head having a valve stem and a resilient biasing means attached on opposite sides thereof. One end of the valve stem bears against the valve head and the other end is juxtapositioned relative to the cap such that the valve stem is displace,d in the direction of the base when the removable cap is flexed and the valve head is displaced from the valve seat thus allowing cleaning fluid to flow from the reservoir into the scrubbing means. The resilient biasing means also bear against the valve head such that the valve head is normally seated in the valve seat thus stopping the flow of cleaning fluid from the reservoir until unseated by movement of the valve stem.

BRIEF DESCRIPTION OF THE DRAWINGS

In the accompanying drawings, in which one of various possible embodiments of the invention is illustrated, corresponding reference characters refer to corresponding parts throughout the several views of the drawings and in which.

DETAILED DESCRIPTION OF THE INVENTION

Figure 1:
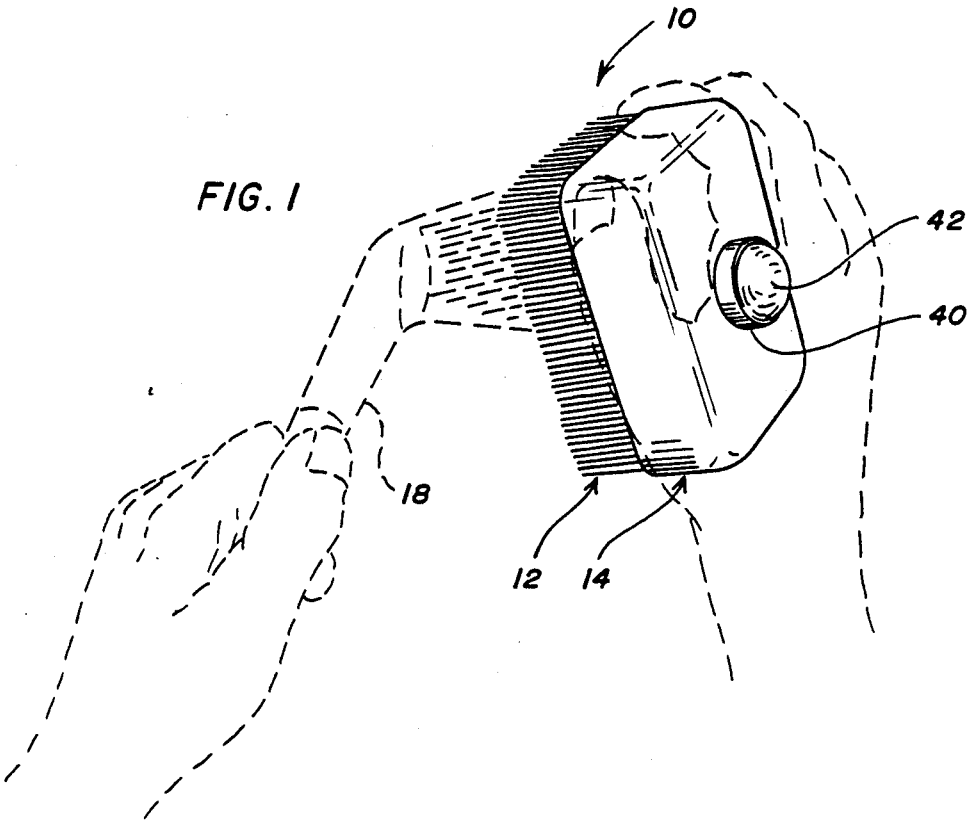
FIG. 1 is a perspective view of a device in accordance with the present invention in use cleaning a golf club.
Figure 2:
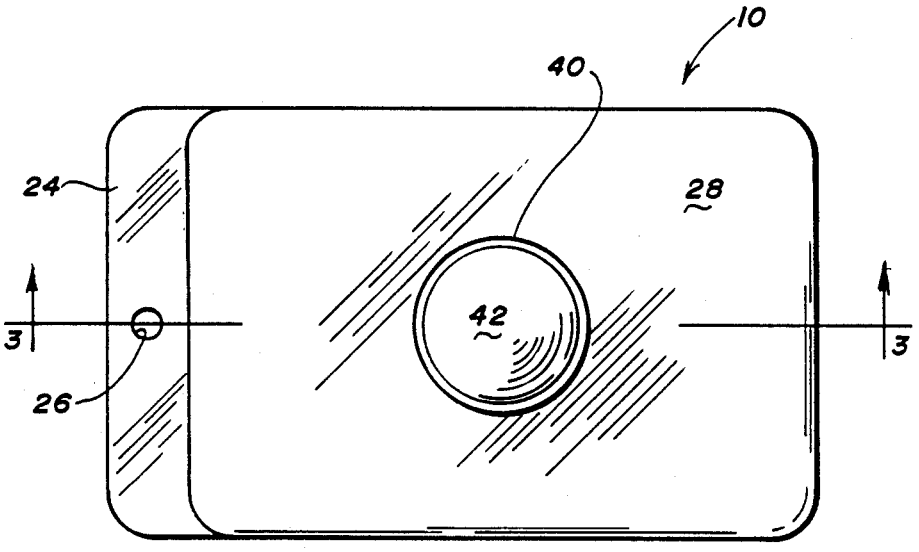
FIG. 2 is plan view of the device.

Referring to the drawings more particularly by reference character, reference numeral 10 refers to a portable cleaning device for golf clubs in accordance with the present invention. Device 10 is made up of a scrubbing means 12 coupled to a fluid container or reservoir 14 which supplies the scrubbing means with cleaning fluid 16. As shown in FIG. 1, scrubbing means 12 is attached to the bottom of reservoir 14 and the device is sized such that the user can grip reservoir 14 with one hand and scrub the face of a golf club 18 with scrubbing means 12 while the club is held in the user's other hand.

Reservoir 14 has generally vertical sidewalls 20 extending upwardly from an integrally molded base 22. Base 22 includes a flange 24 extending outwardly along one side from the intersection between sidewalls 20 and base 22. Flange 24 includes an aperture 26 to provide means for attaching the device to a golfer's belt or golf bag. Opposite the intersection with base 22, sidewalls 20 are bent inwardly forming an integral top 28 with an opening 30.

As illustrated in the drawings, scrubbing means 12 comprise a brush 32 which is attached by its base 34 to base 22 of reservoir 14. The bristles 36 of brush 32 are adapted to enter the grooves of golf club head 18 and thereby to remove undesired material therefrom. An opening 38 in base 34 permits cleaning fluid 16 to flow from reservoir 14 into brush 32 under control of a valve means 39 as more particularly described below.

Figure 3:
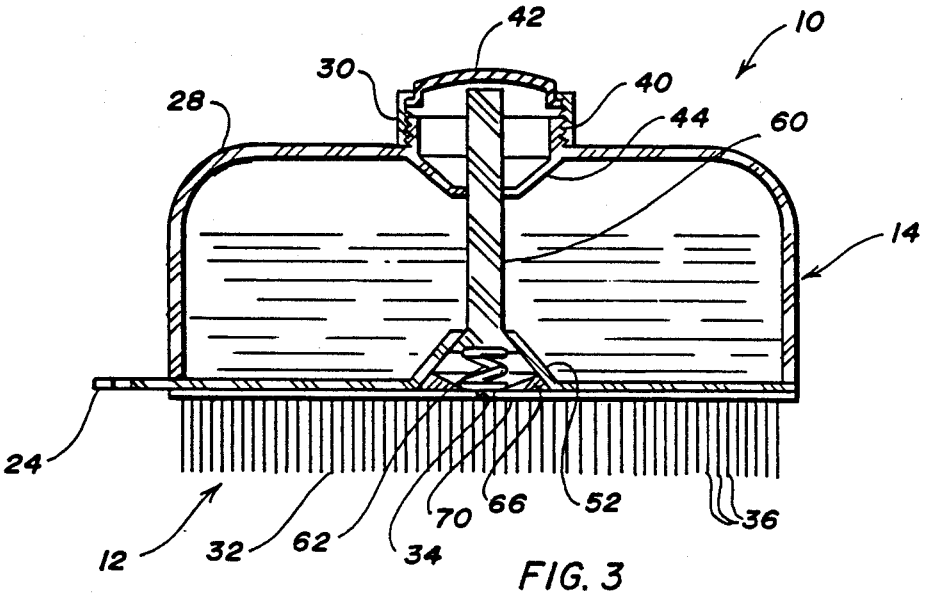
FIG. 3 is a view line along line 3—3 in FIG. 2.
Figure 4:
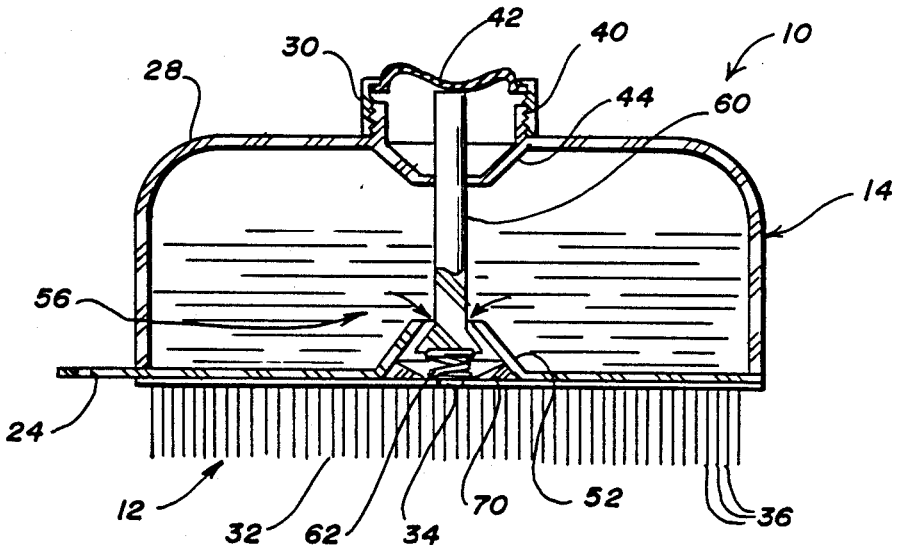
FIG. 4 is a view similar to FIG. 4 but with the valve shown open.

A removable cap 40 is provided on opening 30 to retain cleaning fluid 16 within reservoir 14, yet permit the passage of air such that reservoir 14 does not draw a vacuum and cleaning fluid 16 continues to flow from reservoir 14. The top 42 of cap 40 is resiliently biased or bowed upwardly in a direction away from base 22 as shown in FIG. 3 but is flexible such that it can be depressed downwardly as shown in FIG. 4. A brace 44 is provided in the throat of opening 30 for use as hereinafter described. Brace 44 comprises a plurality of ribs 46 radiating from a ring 48 and attached to the inside of opening 30. Gaps 50 are provided between ribs 46 so that cleaning fluid 16 can be poured without impediment into reservoir 14 through opening 30.

Figure 5:
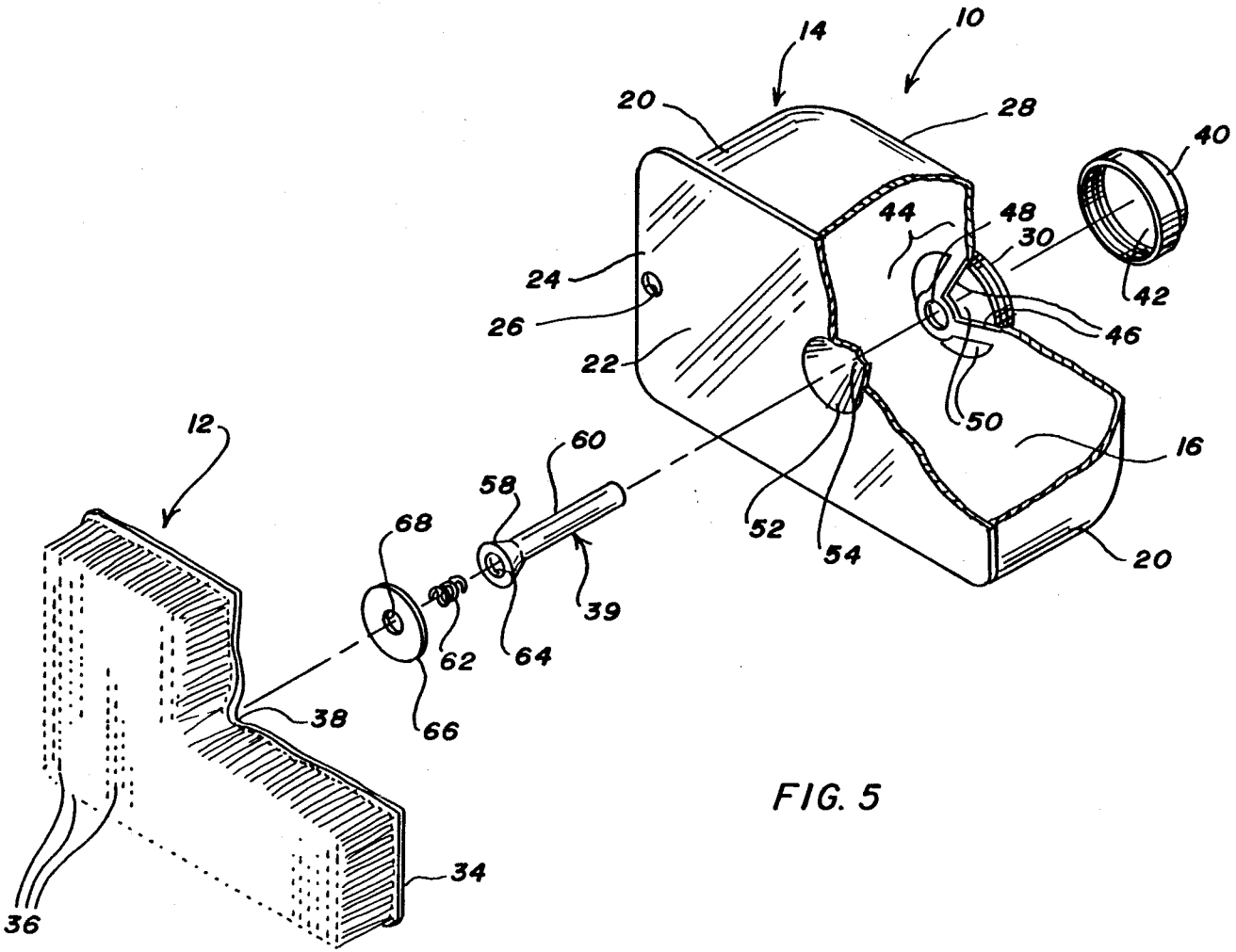
FIG. 5 is a blown apart perspective view of the device.

Referring now to FIG. 5 with regard to valve means 39, it is seen that base 22 of reservoir 14 includes a valve housing 52 with a valve seat 54 which forms a fluid port 56 flowably connected with opening 38 in base 34 of brush 32. An upwardly extending valve head 58 extends into valve seat 54 such that prior to being actuated, as shown in FIG. 3, cleaning fluid 16 in reservoir 14 is not permitted to flow through fluid port 56 and into the brush. One end of a valve stem 60 bears against the upper surface of valve head 58 and the other end passes through ring 48 which serves as a valve stem guide and terminates adjacent top 42 of cap 40 in threaded opening 30. The free end of valve stem 60 is juxtapositioned relative to top 42 such that it is displaced in the direction of base 22 when cap 40 is depressed downwardly as shown in FIG. 4. As valve stem 60 is depressed downwardly valve head 58 is displaced from valve seat 54 and cleaning fluid 16 flows through fluid port 56 and into brush 32.

In rest position, as shown in FIG. 3, a resiliently biasing means 62 illustrated as a coil spring presses against valve head 58 on its lower surface opposite valve stem 60. A small circular recess 64 is provided in the bottom of valve head 58 serving as a retaining ring for the upper coil of spring 62. A washer 66 is received in the base of valve housing 52 with the hole 68 in washer 66 and opening 38 in base 34 being in axial alignment and sized such that the lower coil of spring 62 passes through hole 68 in washer 66 which serves as a retaining ring but not through opening 38 in base 34 which forms a stop. Washer 66 includes a cavity 70 tapered in the direction of hole 68, which in working condition as shown in FIG. 4, receives coil spring 62 as it is compressed and directs cleaning fluid 16 towards aligned hole 68 and opening 38. This occurs as valve head 58 is unseated by valve stem 60 when top 42 is flexed.

In use on a golf course, device 10 can be easily carried on the user's belt or golf bag by attachment of a hook in aperture 26 in flange 24. Preparatory to going on the course, reservoir 14 is filled with cleaning fluid 16, preferably just plain water, which is poured through threaded opening 30 and cap 40 is replaced.

When required on the course, device 10 is held in one hand while golf club 18 is held in the other hand. By straightening the fingers of his hand while gripping device 10 in the palm of his hand, the user can depress top 42 which forces valve stem 60 downwardly and displaces valve head 58 from valve seat 54. With fluid port 56 open, cleaning fluid 16 flows from reservoir 14 through port 56 and aligned hole 68 and opening 38 into brush 32. After brush 32 is wetted, all that is needed to clean golf club head 18 is to move brush 32 up and down across the face of the club to remove any mud, dirt or grass which has been attached to the surface of the head. The head can then be dried with a towel.

It will be seen from the above that device 10 can be used to clean iron-type and wood-type clubs and, in addition to being portable, can be made inexpensively of durable materials and is leak proof.

In view of the above, it will be seen that the several objects of the invention are achieved and other advantageous results attained. As various changes could be made in the above constructions without departing from the scope of the invention, it is intended that all matters contained in the above description or shown in the accompanying drawings shall be interpreted as illustrative and not in a limiting sense.

What is claimed:

1. A portable cleaning device for golf clubs adapted to be held in a palm of a user's hand comprising a reservoir for containing cleaning fluid, a scrubbing brush means attached to the bottom of the reservoir and a valve means for controlling the flow of the cleaning fluid into the scrubbing brush means, said reservoir having a base, sidewalls and a generally rigid closed top with an opening closed with a removable cap which is resiliently biased in a direction away from the base but which is flexible such that it can be flexed in a direction towards the base by the user, said valve means having means for discharging the cleaning fluid in a substantially undivided stream and comprising a valve housing flowably connected with an opening formed in the base of the reservoir with a valve seat above the opening into which is seated a valve head, said valve head having a valve stem and a resilient biasing means positioned on the opposite side thereof, said valve stem having one end secured to the valve head and the other end juxtapositioned relative to the cap such that the valve stem is displaced in the direction of the base when the removable cap is flexed displacing the valve head from the valve seat and allowing cleaning fluid to flow from the reservoir into the scrubbing means and said resilient biasing means bearing against the valve head such that the valve head is normally seated in the valve seat stopping the flow of cleaning fluid from the reservoir.

2. The device of claim 1 wherein the scrubbing means comprise a brush with bristles which are adapted to enter the grooves on a golf club head.

3. the device according to claim 2 wherein the brush has a base with an opening through which the cleaning fluid flows under control of the valve means.

4. The device according to claim 3 wherein a washer is received in the base of the valve housing having a hole in axial alignment with the opening in the base of the brush.

5. The device according to claim 4 wherein the resilient biasing means is a coil spring, one end of which is received in a recess provided in the valve head and the other end of which is received in the hole in the washer.

6. The device according to claim 5 wherein that end of the coil spring passing through the hole in the washer does not pass through the opening in the brush which forms a stop.

7. The device according to claim 6 wherein the washer has a cavity which is tapered in the direction of its hole for receiving the coil spring when it is compressed by movements of the valve head and for directing cleaning fluid towards the aligned hole in the washer and the opening in the brush.

8. The device of claim 2 wherein the base includes a flange extending outwardly along one side from the intersection between the sidewalls and the base, said flange including an aperture providing means for attaching the device to a golfer's belt or golf bag.

* * * * *